US011396817B2

(12) United States Patent
Eshak et al.

(10) Patent No.: US 11,396,817 B2
(45) Date of Patent: Jul. 26, 2022

(54) GAS TURBINE BLADE AND METHOD FOR PRODUCING SUCH BLADE

(71) Applicant: Siemens Energy Global GmbH & Co. KG, Munich (DE)

(72) Inventors: Daniel M. Eshak, Orlando, FL (US); Susanne Kamenzky, Berlin (DE); Andrew Lohaus, Berlin (DE); Daniel Vöhringer, Berlin (DE); Samuel R. Miller, Jr., Port St. Lucie, FL (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 99 days.

(21) Appl. No.: 16/957,244

(22) PCT Filed: Jan. 8, 2019

(86) PCT No.: PCT/US2019/012672
§ 371 (c)(1),
(2) Date: Jun. 23, 2020

(87) PCT Pub. No.: WO2019/194878
PCT Pub. Date: Oct. 10, 2019

(65) Prior Publication Data

US 2020/0392852 A1 Dec. 17, 2020

(30) Foreign Application Priority Data

Jan. 11, 2018 (EP) ..... 18151215

(51) Int. Cl.
*F01D 5/18* (2006.01)
*F01D 5/14* (2006.01)

(52) U.S. Cl.
CPC ..... *F01D 5/18* (2013.01); *F01D 5/147* (2013.01); *F05D 2230/21* (2013.01);
(Continued)

(58) Field of Classification Search
CPC ..... F01D 5/18; F01D 5/187; F01D 5/147; F05D 2220/32; F05D 2230/21;
(Continued)

(56) References Cited

U.S. PATENT DOCUMENTS 3,908,733 A 9/1975 Brazer et al.
6,257,828 B1 7/2001 Bischoff-Beiermann et al.
(Continued)

FOREIGN PATENT DOCUMENTS

CN 101749052 A 6/2010
CN 203835465 U 9/2014
(Continued)

OTHER PUBLICATIONS

PCT International Search Report and Written Opinion of International Searching Authority dated Jul. 10, 2019 corresponding to PCT International Application No. PCT/EP2019/065290 filed Aug. 1, 2019.
(Continued)

*Primary Examiner* — Ninh H. Nguyen

(57) ABSTRACT

A gas turbine blade having a casted metal airfoil, the airfoil has a main wall defining at least one interior cavity, having a first side wall and a second side wall, which are coupled to each other at a leading edge and a trailing edge, extending in a radial direction from a blade root to a blade tip and defining a radial span from 0% at the blade root to 100% at the blade tip. The main airfoil has a radial span dependent chord length defined by a straight line connecting the leading edge and the trailing edge as well as a radial span dependent solidity ratio of metal area to total cross-sectional area. Solidity ratios in a machined zone of the airfoil from 80% to 85% of span are below 35%, in particular all solidity ratios in the zone.

19 Claims, 7 Drawing Sheets

(52) U.S. Cl.
CPC ..... *F05D 2240/301* (2013.01); *F05D 2240/304* (2013.01); *F05D 2260/20* (2013.01)

(58) Field of Classification Search
CPC ..... F05D 2230/10; F05D 2230/14; F05D 2240/301; F05D 2240/304; F05D 2240/307; F05D 2260/20; F05D 2260/941
See application file for complete search history.

(56) References Cited

U.S. PATENT DOCUMENTS

| | | | | |
|---|---|---|---|---|
| 8,277,193 | B1 | 10/2012 | Brostmeyer et al. | |
| 8,500,411 | B2 * | 8/2013 | Marra | B23P 15/02 416/232 |
| 8,720,526 | B1 | 5/2014 | Campbell et al. | |
| 2008/0145236 | A1 | 6/2008 | Liang | |
| 2012/0269649 | A1 | 10/2012 | Rawlings et al. | |
| 2014/0130999 | A1 | 5/2014 | Campbell et al. | |
| 2016/0237827 | A1 | 8/2016 | Campbell et al. | |

FOREIGN PATENT DOCUMENTS

| | | | |
|---|---|---|---|
| CN | 104929696 | A | 9/2015 |
| CN | 104956032 | A | 9/2015 |
| DE | 1007565 | B | 5/1957 |
| JP | H10212903 | A | 8/1998 |
| JP | 2015536404 | A | 12/2015 |

OTHER PUBLICATIONS

Songli: "Design Technology of Highly Loaded Supersonic And Transonic Compressor Rotor"; Harbin Institute of Technology; Date: Feb. 15, 2012, pp. 1-59.

* cited by examiner

GAS TURBINE BLADE AND METHOD FOR PRODUCING SUCH BLADE

CROSS REFERENCE TO RELATED APPLICATIONS

This application is the US National Stage of International Application No. PCT/US2019/012672 filed 8 Jan. 2019, and claims the benefit thereof. The International Application claims the benefit of European Application No. EP18151215 filed 11 Jan. 2018. All of the applications are incorporated by reference herein in their entirety.

FIELD OF INVENTION

The present invention relates to a gas turbine blade having a casted metal airfoil, said airfoil comprising a main wall defining at least one interior cavity, having a first side wall and a second side wall, which are coupled to each other at a leading edge and a trailing edge, extending in a radial direction from a blade root to a blade tip and defining a radial span from 0% at the blade root to 100% at the blade tip, wherein said airfoil has a radial span dependent chord length defined by a straight line connecting the leading edge and the trailing edge as well as a radial span dependent solidity ratio of metal area to total cross-sectional area.

BACKGROUND OF INVENTION

The design of rotating gas turbine blades in a gas turbine engine is of great importance in terms of efficiency, with which the gas flow passing through the gas turbine engine interacts with the blades. In order to achieve higher power output, efficiency and economic attractiveness, new generations of industrial gas turbines tend to have larger and larger blades rotating at a fixed frequency of 50 Hz or 60 Hz. This is a challenge because of the competing needs of aerodynamics, mechanical integrity and manufacturing.

For acceptable aerodynamic performance, the pitch-to-chord ratios of the tip section of the blade need to be kept around 1.0. The pitch-to-chord ratio is defined by $$2\pi[(r_t^2+r_h^2)/2]^{0.5}/c$$

wherein $r_t$ is the outer radius from the engine centerline to the blade tip, $r_h$ is the inner radius from the engine centerline to the blade root and c is the chord length.

So for a taller blade the ideal tip chord length will actually increase compared to a smaller blade in view of aerodynamic performance.

However, this goes counter to the needs of mechanical integrity, where tensile loads increase with rotational speed and mass, which are proportional to the span and the chord length, respectively. In order to maintain tensile loads at some constant acceptable level across the entire span of the blade, a compounding increase in cross-sectional area moving from the tip to the root of the airfoil is required. For a given airfoil span, cross-sectional area at the tip and tensile stress limit that must be held across the full span, the minimum required cross section of metal at the root of the airfoil is then determined by an integral equation.

Gas turbine blades are usually produced by means of investment casting of nickel-base super alloys around ceramic cores that, once removed, provide interior cavities for cooling air and/or reduced weight. Limitations in wall thickness, ceramic core thickness and trailing edge thickness correlate with part size and weight. For instance, minimum wall thicknesses of about 3 mm must be met at the tip, and then increase at a rate of 1% relative to the span while moving down the airfoil for an economical casting on the order of one meter in length. These taper requirements can lead to wall thicknesses and section areas in the upper span of the airfoil in excess of that needed to meet tensile stress limits, adding unnecessary weight that is then a challenge for the lower spans of the airfoil.

Advanced casting processes commonly used for smaller airfoils such as directional solidification or single crystal can improve dimensional limits to an extent, but are uneconomical for very large airfoils.

Minimum dimensions on wall thickness, core thickness, and trailing edge thickness (from the conventional casting process) will combine with the minimum required tip chord length for aerodynamics to give a theoretical minimum cross sectional area at the tip of the blade. If no further action is taken to reduce the mass in the upper sections, the lower sections of a large blade will have exponentially increasing absolute sectional areas at the root. This additional tapering for the casting process creates penalties for aerodynamics due to excessive blockage, penalties for mechanical integrity due to high stresses, and penalties for economics due to larger rotors, casings and bearings required to support the increased mass of the entire blade.

In summary, conventional manufacturing processes limit the airfoil span that is simultaneously acceptable aerodynamically, mechanically, and economically.

$AN^2$, as defined by the annulus area (A) swept by the blade in square meters [$m^2$] times the square of the rotational speed ($N^2$) in revolutions per minute [$1/min^2$], can be used as a measure of blade relative size. To date, no known operating gas turbine blade has exceeded a value of 7.0 $e^7$ $m^2/min^2$ due to the above-mentioned competing needs of aerodynamics, mechanical integrity and manufacturing. Known gas turbine blades rather fall in the range of 6.0 $e^7$ to 6.8 $e^7$ $m^2/min^2$. Such blades reaching values of about 6.0 $e^7$ $m^2/min^2$ may use directionally solidified alloys and omit cooling, use a complex combination of hollow tip shrouds and cooling holes drilled over the entire span, or use a conventionally cast airfoil and limit span and exhaust temperature. However, all of these designs rely on a tip-shrouded configuration that requires higher airfoil counts as well as trailing edge losses. Also, the lack of cooling or minimum amount of cooling limits the maximum exhaust temperature possible for these turbines, thus penalizing steam cycle efficiency and upgrade potential.

SUMMARY OF INVENTION

Against this background it is an object of the present invention to provide a gas turbine blade of the above-mentioned type that enables a gas turbine engine to run with higher power output, efficiency and economic attractiveness.

In order to solve this object, the present invention provides a gas turbine blade of the above-mentioned kind, which is characterized in that solidity ratios in a machined zone of the airfoil from 80% to 85% of span are below 35%, in particular all solidity ratios in said zone, wherein the machined zone advantageously extends exclusively within 16% to 100% of span.

Since the tip chord length is set by aerodynamics, and wall and core thicknesses are set by casting and heat-transfer criteria, respectively, another way of defining the gas turbine blade of the present invention is by looking at the solidity ratios, i.e. the ratio of metal area to total cross-sectional area. This ratio can be considered as a measure of the efficiency of the blade as a structure. The ideal free-standing blade would have a solidity approaching zero at the tip, with vanishingly thin walls in order to reduce the pull load upon the lower sections, and a large chord length at the tip for good performance. The ideal root section of a cooled free standing blade that is intended for the last row of a gas turbine engine will have a high solidity, beyond 70%. This is because a large amount of metal is required to support the pull load of the upper sections and only a small core passage is required to pass a sufficient amount of cooling air to mitigate creep failure. Front-stage airfoils will maintain more moderate solidity throughout their span since pull load at the tip is not as critical due to the small span, and the root sections need to be more heavily cooled to resist oxidation.

High solidity near the hub is not a challenge from manufacturing perspective, but low solidity near the tip is a challenge due to the aforementioned wall thickness requirements during casting. The invention is embodied by the local application of tip-machining to achieve solidity ratios below 35% from 80% to 85% of span, and then reverting to conventional levels of solidity, such as 50% to 75% in the lower half of the airfoil that needs thick walls anyways to bear the pull load of the airfoil above it. Thus, airfoil machining is applied in a specific and targeted manner to turn an economical casting into an aerodynamically and mechanically optimal airfoil. Thanks to such a blade tip configuration it is possible to design blades with $AN^2$ greater than 7.0 $e^7$ $m^2$/min.

Preferably, the solidity ratios at 75% to 90% of span are below 35%, in particular all solidity ratios in said zone. Such a configuration of the blade tip leads to even better results.

According to an aspect of the present invention a wall thickness of the main wall extending from an external surface of the main wall to the interior cavity is constant in a zone from 85% to 100% of span. Thus, a minimum wall thickness can be adjusted in this zone.

A wall thickness of the main wall extending from an external surface of the main wall to the interior cavity advantageously increases by a rate of 1% or greater relative to span from 60% to 0% of span in order to meet the tensile stress requirements.

Advantageously, a wall thickness of the main wall at the blade tip extending from an external surface of the main wall to the interior cavity lies within a range from 1 to 2 mm.

According to an aspect of the present invention the chord lengths in a zone from 50% to 70% of span, in particular in a zone from 50% to 90% of span, are shorter than the chord length at 100% of span, in particular all chord lengths in said zone. This is possible thanks to the inventive minimization of the pull load in the upper spans due to the low solidity ratio.

Preferably, a trailing edge thickness is thinnest in a zone from 60% to 80% of span, in particular in a zone from 68% to 72% of span.

The trailing edge thickness at 100% of span advantageously lies within a range from 2.5 to 4.0 mm.

The machined zone advantageously extends along the entire circumference of the airfoil at a given radial height.

Advantageously, the external surface of the airfoil is in an as-cast condition over a partial span starting from the blade root, in particular in a region from 0% to 5% of span.

In order to solve the above-mentioned object the present invention further provides a method for producing such gas turbine blade, comprising the steps of casting a hollow airfoil and machining the external surface of said casted airfoil exclusively within a zone from 16% to 100% of span in order to reduce the wall thickness of the main wall and/or the trailing edge thickness in said zone.

The machining is advantageously done by milling, grinding, EDM or ECM, in particular during one single milling, grinding, EDM or ECM operation.

Further features and advantages of the present invention will become apparent in the context of the following description of an embodiment of a gas turbine blade according to the invention with reference to the accompanying drawing. In the drawing The present invention further proposes to use a gas turbine blade according to invention in the last turbine stage of a gas turbine, i.e. in the most downstream turbine stage. This makes it possible to reach a value of $AN^2$ greater than 7.0 $e^7$ $m^2/min^2$.

DETAILED DESCRIPTION OF INVENTION

Figure 1:
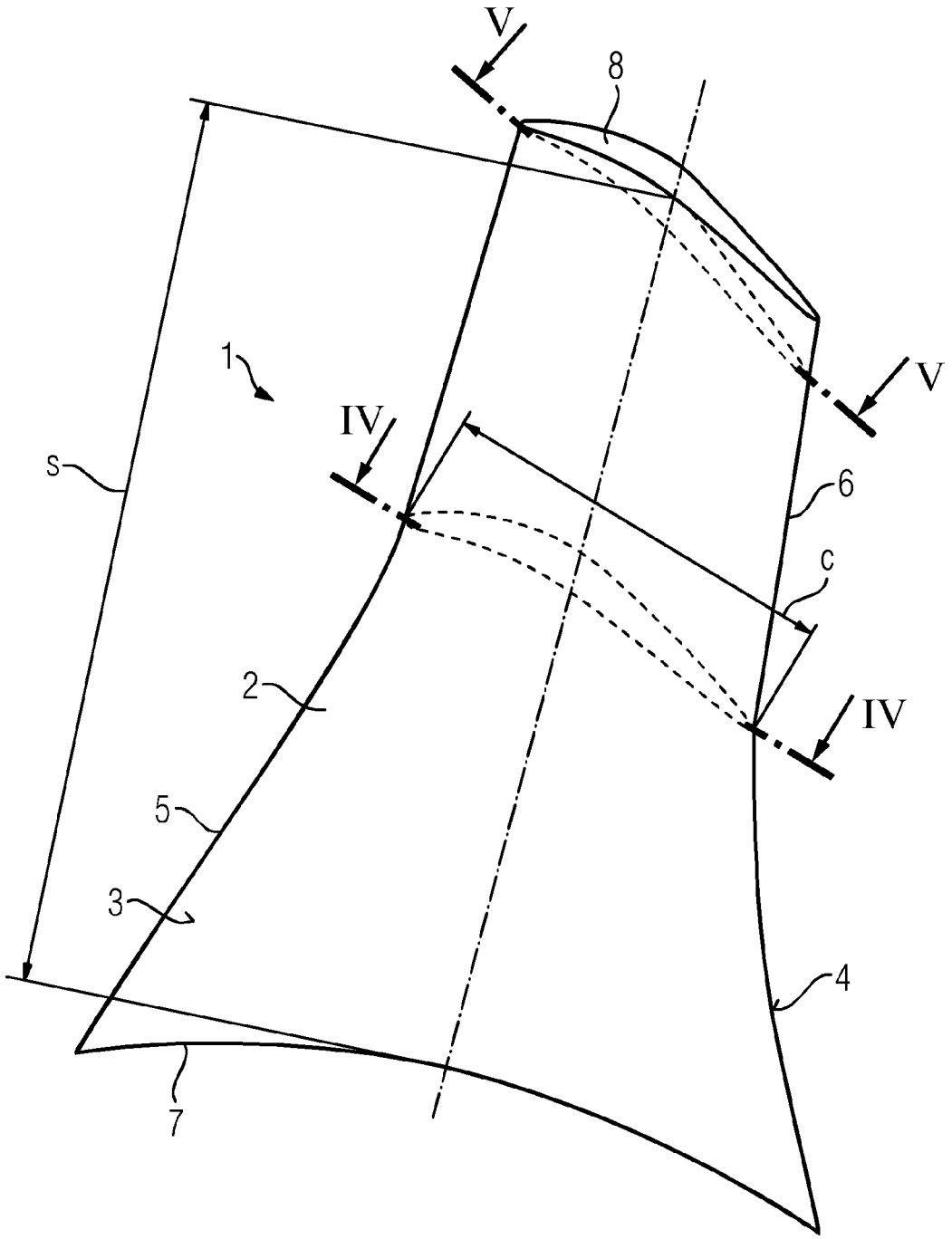
FIG. 1 is a perspective view of a gas turbine blade according to an embodiment of the present invention.
Figure 2:
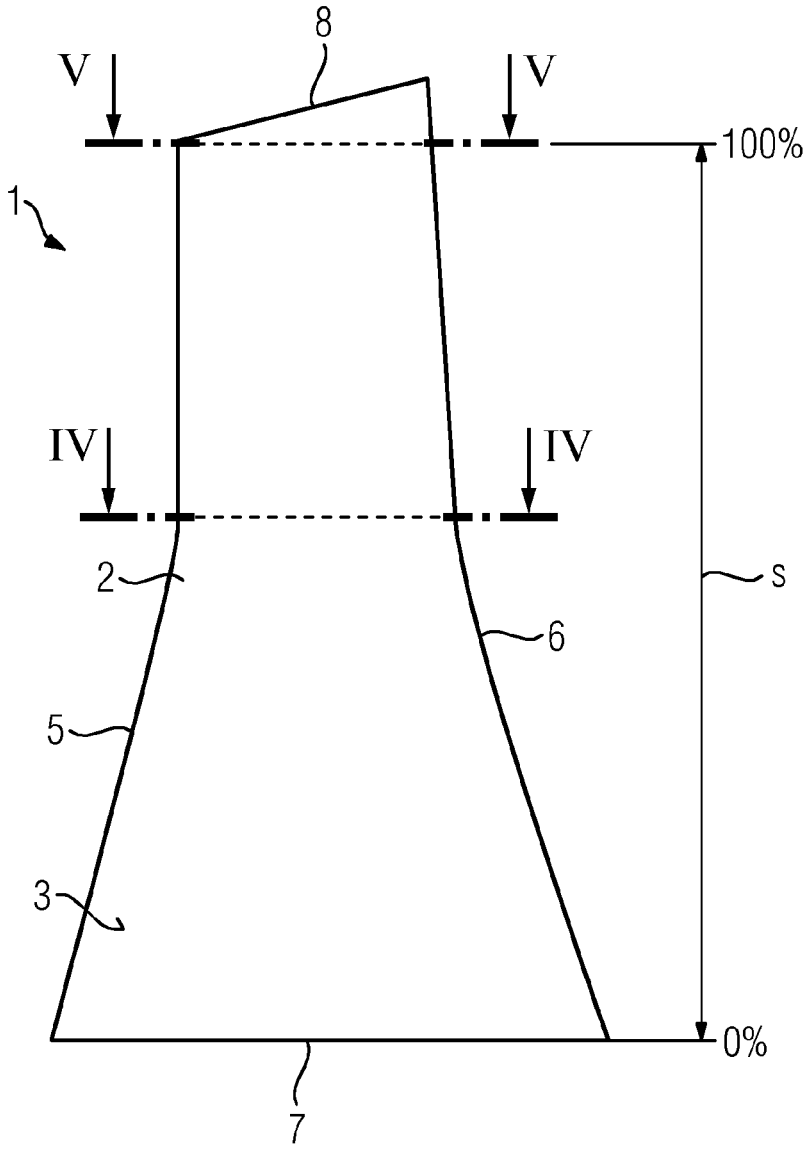
FIG. 2 is a front view of the blade.

FIGS. 1 and 2 show different views of a gas turbine blade 1 according to an embodiment of the present invention. The gas turbine blade 1 comprises a metal airfoil 2 with a main wall having a first side wall 3 and a second side wall 4, which are coupled to each other at a leading edge 5 and a trailing edge 6. The airfoil 2 extends in a radial direction from a blade root 7 to a blade tip 8, defines a radial span s from 0% at the blade root 7 to 100% at the blade tip 8, has a radial span dependent chord length c defined by a straight line connecting the leading edge 5 and the trailing edge 6, and has a radial span dependent solidity ratio $r_s$ of metal area to total cross-sectional area. Moreover, the main wall defines three interior cavities 9, which are separated from each other by partition walls 10 each extending between the first side wall 3 and the second side wall 4.

Figure 3:
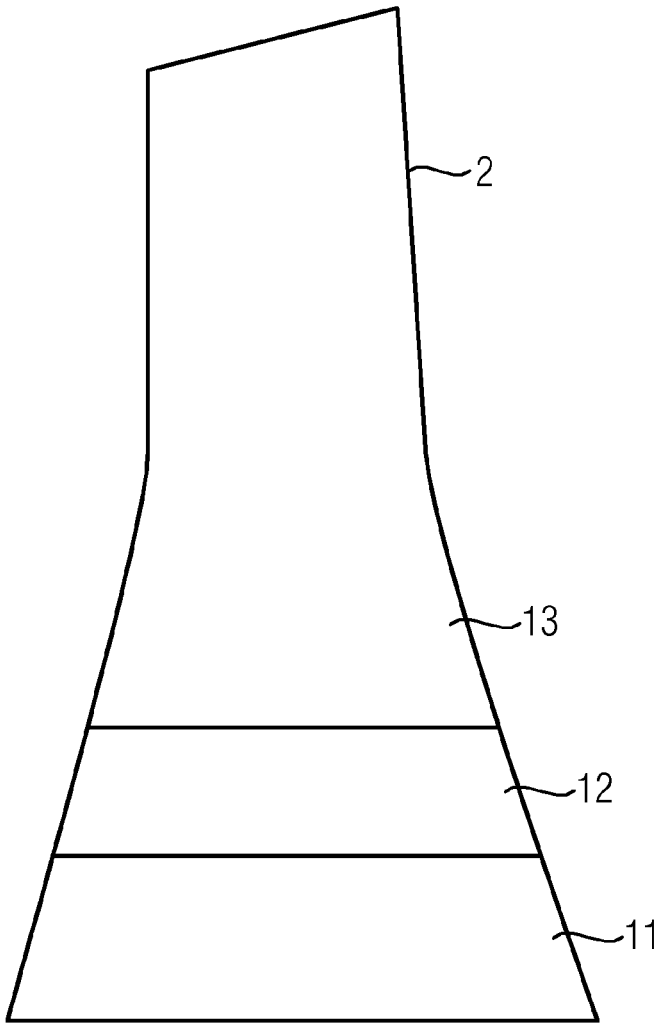
FIG. 3 is a front view of the blade as FIG. 2 showing machined and as-cast regions

The gas turbine blade 1 is a casted product, whereas the external surface of the main wall of the casted airfoil 2 is exclusively machined within a zone from 16% to 100% of span s as shown in FIG. 3, advantageously by milling. Thus, the airfoil 2 can be subdivided into an as-cast region 11 extending radially outwards from the blade root 7, a subsequent transition region 12, which may or may not be machined, and a subsequent machined region 13. The machining is done in order to reduce the wall thickness of the main wall as well as the trailing edge thickness in the machined zones or rather in order to achieve the results shown in FIGS. 4 to 9.

Figure 4:
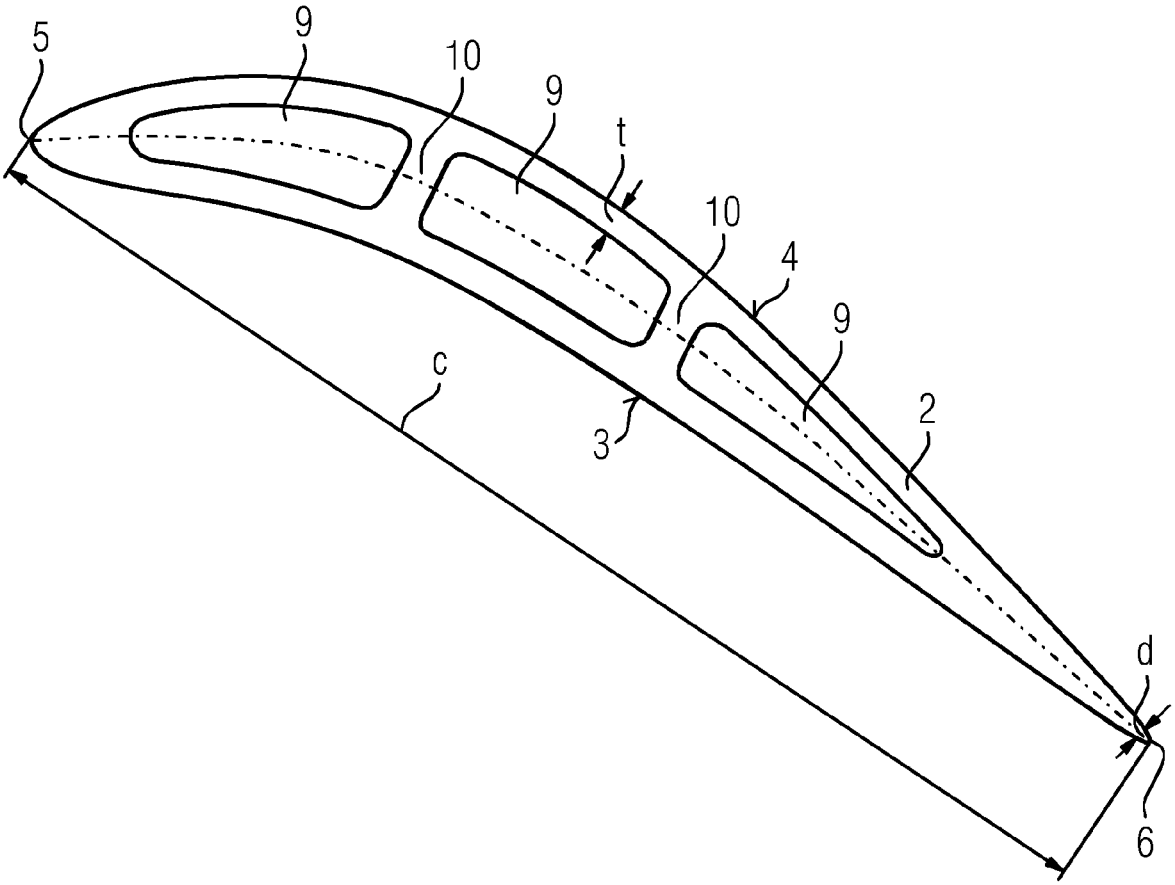
FIG. 4 is a sectional view of the blade along lines IV-IV in FIGS. 1 and 2.
Figure 5:
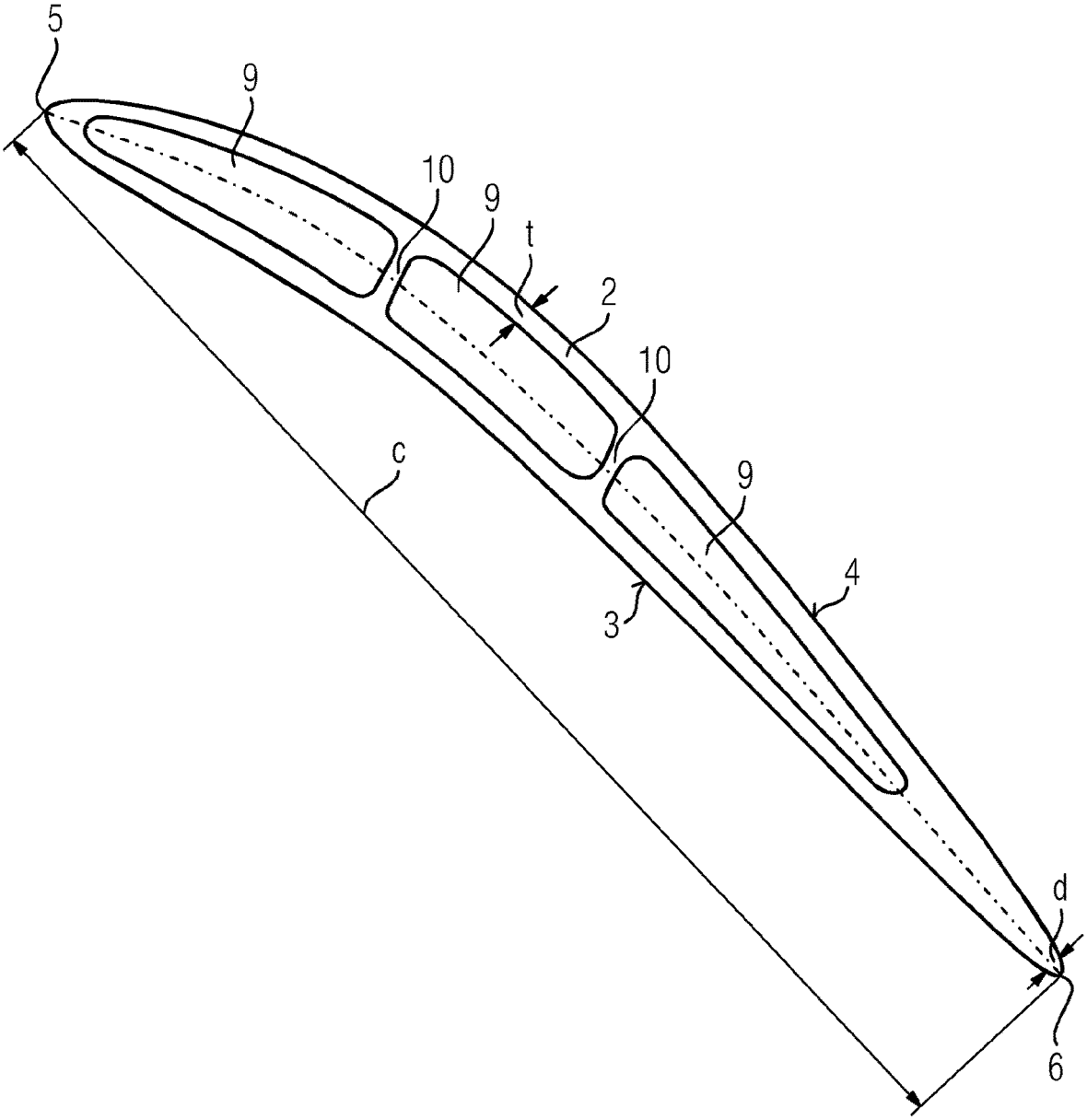
FIG. 5 is a sectional view of the blade along lines V-V in FIGS. 1 and 2.

FIGS. 4 and 5 show cross sectional views of the airfoil 2 at about 58% of span (FIG. 4) and at 100% of span (FIG. 5). It can be seen by comparison that the wall thickness t at 58% of span is much thicker than at 100% of span. In the present case, the wall thickness at 58% of span is about 4 mm, whereas the wall thickness at 100% of span is about 1 mm.

Figure 6:
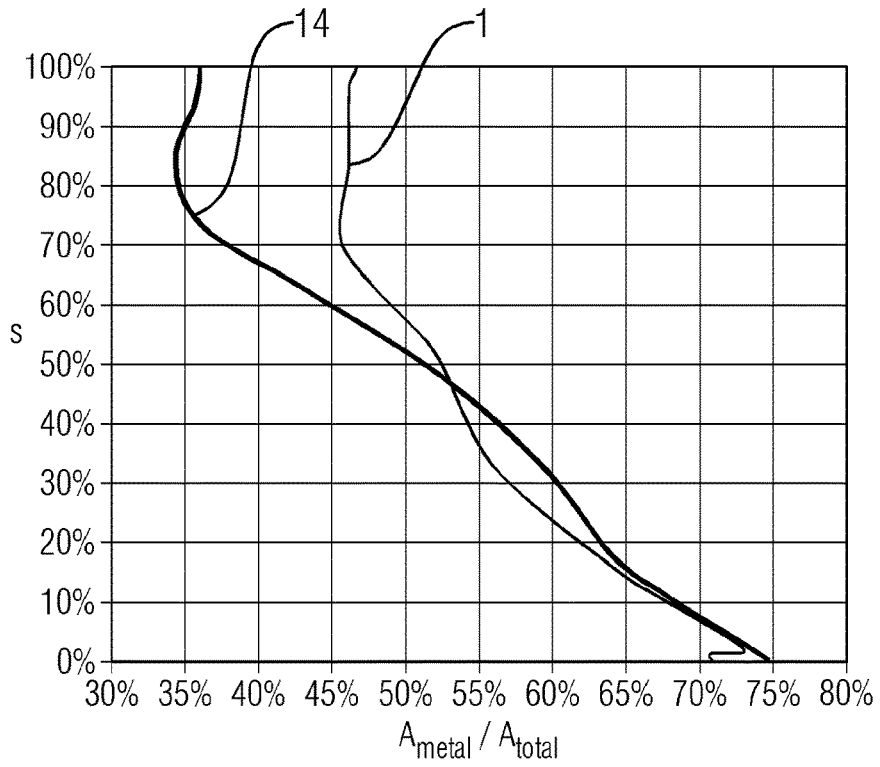
FIG. 6 is a graph showing the solidity ratio relative to radial span for the blade shown in FIGS. 1 to 4 and for a prior art blade having an as-cast design.

FIG. 6 shows the solidity ratio $r_s$ relative to radial span s for the blade 1 and for a prior art blade having an as-cast design designated by reference numeral 14. The solidity ratios $r_s$ of the blade 1 are below 35% from 90% to 75% of span s in order to reduce the pull load upon the lower sections, and then revert to conventional levels of 50% to 75% in the lower half of the airfoil 2 that needs thicker walls to bear the pull load exerted by the upper airfoil sections.

Figure 7:
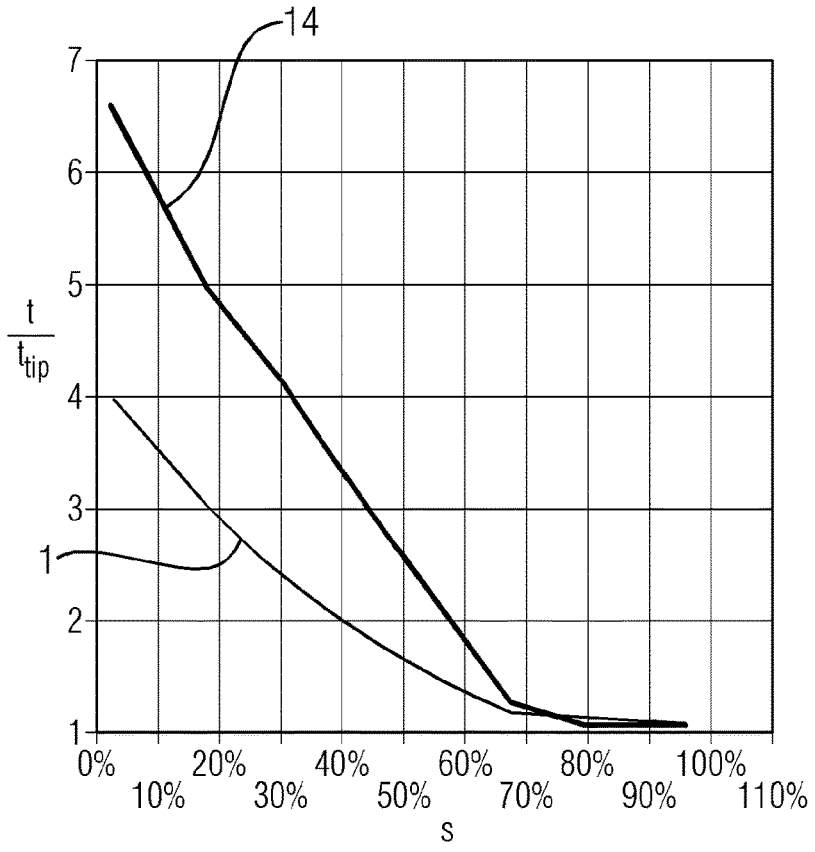
FIG. 7 is a graph showing the ratio of wall thickness/tip wall thickness relative to radial span for the blade shown in FIGS. 1 to 4 and for said prior art blade having the as-cast design.

FIG. 7 shows the ratio of wall thickness/tip wall thickness relative to radial span s for the blade 1 and for said prior art blade 14 having the as-cast design. The blade 1 has no taper in wall thickness t from 100% to 85% of span, and then tapers greater than 1% in the lower 60% of span. This results in an airfoil that has thin walls at the blade tip 8 and then a higher increase in relative thickness than would be practical with conventional casting processes. It should be noted that both blades 1 and 14 have similar absolute wall thicknesses at 0% of span due to packaging and aerodynamic constraints, but the relative increase in wall thickness is what is critical for mechanical and casting criteria. The wall thickness ratios of blade 1 according to the present invention are generally not possible with conventional casting and are achieved by using adaptive airfoil machining in the upper span regions, i.e. by removing an amount of material in terms of wall thickness reduction that is variable relative to radial span s.

Figure 8:
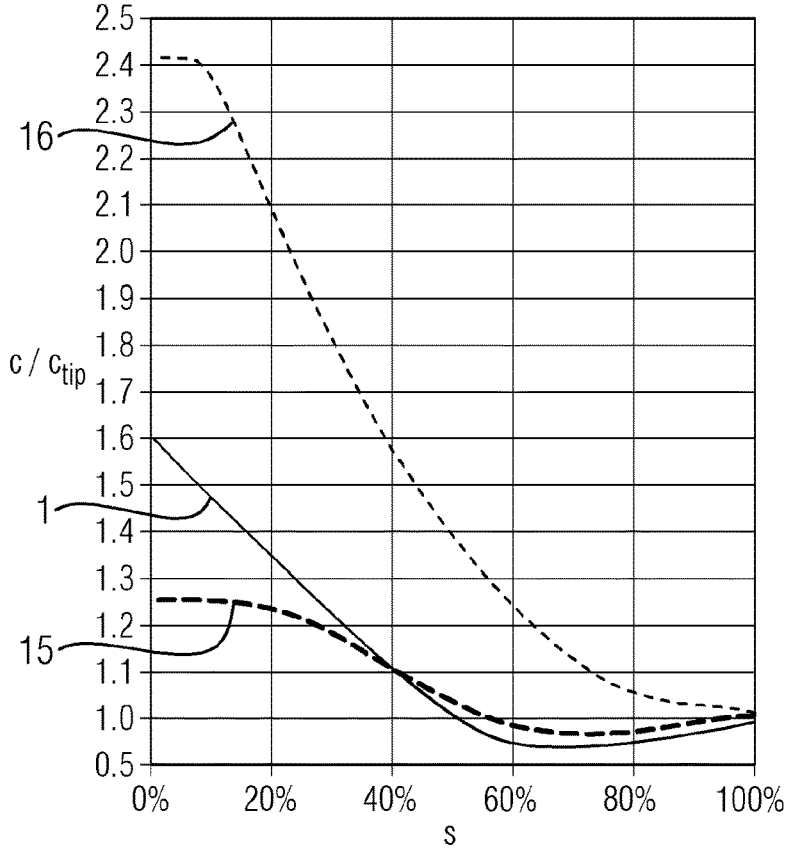
FIG. 8 is a graph showing the radial span relative to the ratio of the chord length/tip chord length for the blade shown in FIGS. 1 to 4, for a prior art freestanding blade, which is not cored, and for a prior art shrouded blade.

By minimizing pull load in the upper spans thanks to thin walls and low solidity ratios the airfoil 2 can also have reduced chord lengths that are actually lower than the tip chord length until 50% of span. FIG. 8 shows in this context the radial span relative to the ratio of the chord length/tip chord length for the blade 1, for a prior art freestanding blade 14 and for a prior art shrouded blade 16. Since a constant pitch-to-chord ratio of 1:1 is ideal aerodynamically, the ideal chord length should decrease while moving down the airfoil 2. However, this is generally not possible because of the additional metal needed to meet casting requirements and support the pull load of the upper sections of the airfoil 2. The very low solidity ratio $r_s$ of the airfoil 2 from 70% to 100% of span enables shorter chord lengths c from 70% to 50% of span. The prior art free standing blade 15 can achieve lower tip chord multiples in the lower 40% of span only because the airfoil is not cored in this region.

Figure 9:
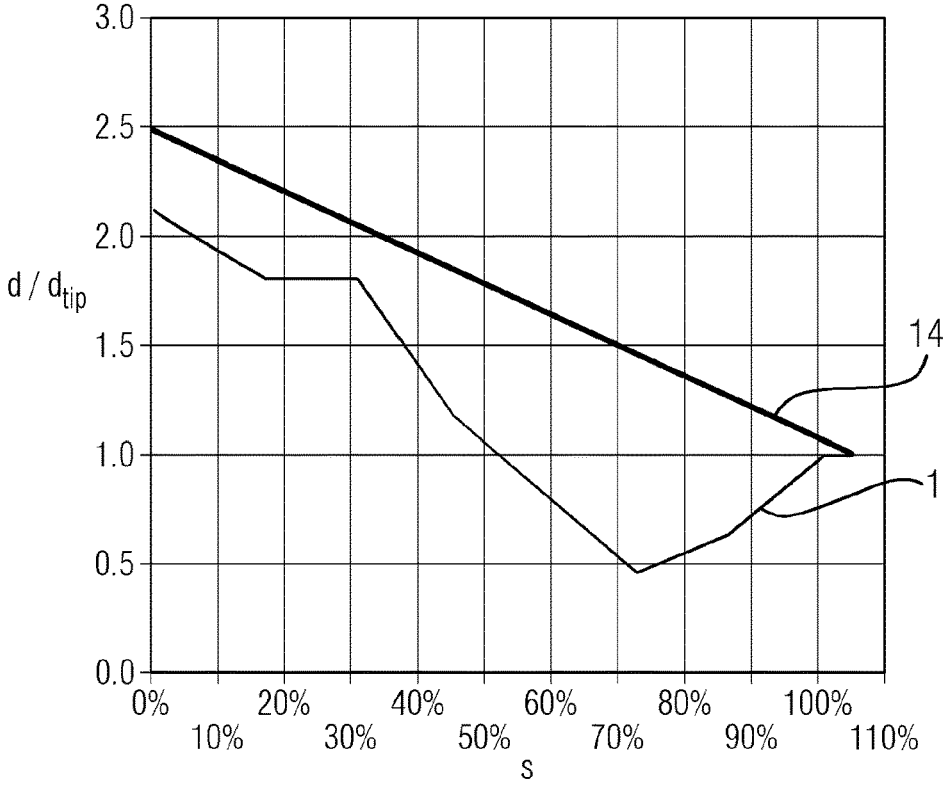
FIG. 9 is a graph showing the radial span relate to the ratio of tip trailing edge width/trailing edge width for the blade shown in FIGS. 1 to 4 and for said prior art blade having the as-cast design.

FIG. 9 shows the radial span relative to the ratio of tip trailing edge width/trailing edge width for the blade 1 and for said prior art blade 14 having the as-cast design. The prior art blade 14 having the as-cast design has a continuous increase in trailing edge thickness in accordance with typical taper requirements. The blade 1 has a trailing edge thickness d that is thinnest at about 70% of span as a result of the machining process. This provides further aerodynamic advantage by reducing trailing edge losses. The absolute trailing edge thickness at the blade tip 8 is between 2.5 mm and 3.5 mm.

All of these features combine in an airfoil 2 with an $AN^2$ greater 7.0 $e^7$ $m^2/min^2$.

It should be noted that the described embodiment of a gas turbine blade according to the present invention is not limiting for the invention. Rather, modifications are possible without departing from the scope of protection defined by the accompanying claims.

The invention claimed is:

1. A gas turbine blade, comprising:

a casted metal airfoil, said airfoil comprising a main wall defining at least one interior cavity and having a first side wall and a second side wall, which are coupled to each other at a leading edge and a trailing edge, wherein the first and second side walls extend in a radial direction from a blade root to a blade tip and define a radial span from 0% at the blade root to 100% at the blade tip, wherein said airfoil has a radial span dependent chord length defined by a straight line connecting the leading edge and the trailing edge as well as a radial span dependent solidity ratio of metal area to total cross-sectional area, wherein the solidity ratio in a machined zone of the airfoil from 75% to 90% of span is below 35%.

2. The gas turbine blade according to claim 1, wherein the solidity ratio at 80% to 85% of span is below 35%.

3. The gas turbine blade according to claim 2, wherein the airfoil comprises a plurality of solidity ratios in the machined zone, and wherein the plurality of solidity ratios in the machined zone are below 35%.

4. The gas turbine blade according to claim 1, wherein a wall thickness of the main wall extending from an external surface of the main wall to the at least one interior cavity is constant in a zone from 85% to 100% of span.

5. The gas turbine blade according to claim 1, wherein a wall thickness of the main wall extending from an external surface of the main wall to the at least one interior cavity increases by a rate of 1% or greater from 60% to 0% of span.

6. The gas turbine blade according to claim 1, wherein a wall thickness of the main wall at the blade tip extending from an external surface of the main wall to the at least one interior cavity is within a range from 1 to 2 mm.

7. The gas turbine blade according to claim 1, wherein the chord length in a zone from 50% to 70% of span is shorter than the chord length at 100% of span.

8. The gas turbine blade according to claim 7, wherein the airfoil comprises a plurality of chord lengths in the zone, and wherein the plurality of chord lengths in the zone are shorter than the chord length at 100% of span.

9. The gas turbine blade according to claim 1, wherein a trailing edge thickness is thinnest in a zone from 60% to 80% of span.

10. The gas turbine blade according to claim 1, wherein a trailing edge thickness at 100% of span is within a range from 2.5 to 4.0 mm.

11. The gas turbine blade according to claim 1, wherein the machined zone extends along an entire circumference of the airfoil at a given radial height.

12. The gas turbine blade according to claim 1, wherein an external surface of the airfoil is an as-cast region over a partial span starting from the blade root.

13. The gas turbine blade according to claim 12, wherein the partial span is at least in a region from 0% to 5% of span.

14. A method for producing the gas turbine blade according to claim 1, comprising:

obtaining the casted airfoil by casting and machining an external surface of said casted airfoil exclusively within a zone from 16% to 100% of span in order to reduce a wall thickness of the main wall and/or a trailing edge thickness in said zone.

15. The method according to claim 14, wherein the machining is done by milling, grinding, EDM or ECM.

16. A gas turbine, comprising:

a last turbine stage comprising the gas turbine blade of claim 1.

17. The gas turbine blade according to claim 1, wherein the airfoil comprises a plurality of solidity ratios in the machined zone, and wherein the plurality of solidity ratios in the machined zone are below 35%.

18. The gas turbine blade according to claim 1, wherein the chord length in a zone from 50% to 90% of span is shorter than the chord length at 100% of span.

19. The gas turbine blade according to claim 18, wherein the airfoil comprises a plurality of chord lengths in the zone, and wherein the plurality of chord lengths in the zone are shorter than the chord length at 100% of span.

* * * * *